US009948029B1

(12) United States Patent
O'Neal, Jr. et al.

(10) Patent No.: US 9,948,029 B1
(45) Date of Patent: Apr. 17, 2018

(54) PERIPHERAL DEVICE COUPLING

(71) Applicant: Daplie, Inc., Pleasant Grove, UT (US)

(72) Inventors: Alvin Alexander O'Neal, Jr., Pleasant Grove, UT (US); Bryson Craig Hill, Pleasant Grove, UT (US); Damian Moroni Pacheco Solano, Pleasant Grove, UT (US)

(73) Assignee: Daplie, Inc., Pleasant Grove, UT (US)

( * ) Notice: Subject to any disclaimer, the term of this patent is extended or adjusted under 35 U.S.C. 154(b) by 0 days.

(21) Appl. No.: 15/276,687

(22) Filed: Sep. 26, 2016

Related U.S. Application Data

(60) Provisional application No. 62/222,980, filed on Sep. 24, 2015.

(51) Int. Cl.
*H01R 13/62* (2006.01)
*H01R 13/631* (2006.01)

(52) U.S. Cl.
CPC ..... *H01R 13/631* (2013.01)

(58) Field of Classification Search
CPC ..... H01R 13/631; G02B 6/38
USPC ..... 439/376; 385/57
See application file for complete search history.

(56) References Cited

U.S. PATENT DOCUMENTS 4,778,400 A * 10/1988 Jacobs ..... H01R 13/631 439/152
5,306,174 A * 4/1994 Kiga ..... H01R 13/639 348/E5.026
9,450,338 B2 * 9/2016 Reeves ..... H01R 13/631
2008/0050979 A1 * 2/2008 Chiang ..... G06F 1/1632 439/676
2012/0266880 A1 * 10/2012 Young ..... A61M 16/0051 128/203.26
2013/0183000 A1 * 7/2013 Erdman ..... G02B 6/3886 385/57

(Continued)

OTHER PUBLICATIONS

Wikipedia, "OAuth," (Open Standard for Authorization), retrieved from https://en.wikipedia.org/wiki/OAuth Dec. 20, 2016 (5 pages).

(Continued)

*Primary Examiner* — Abdullah Riyami
*Assistant Examiner* — Nader Alhawamdeh
(74) *Attorney, Agent, or Firm* — Patent Law Works LLP

(57) ABSTRACT

A self-aligning mechanism is described and may include a first coarse guide component connected to a first device and a second coarse guide component connected to a second device, the first coarse guide component configured to interact with the second coarse guide component to positionally align a connector pair, the coarse guide components configured to prevent a connector from being inserted into a connector receptacle until the connector and the connector receptacle are positionally aligned. The mechanism may also include a first fine guide component connected to the first device and a second fine guide component connected to the second device, the first fine guide component configured to interact with the second fine guide component to rotationally align the connector with the connector receptacle, the fine guide components configured to prevent the connector from being inserted into the connector receptacle until the connector and the connector receptacle are rotationally aligned.

11 Claims, 9 Drawing Sheets

(56) References Cited

U.S. PATENT DOCUMENTS

2016/0043509 A1* 2/2016 Reeves ..... H01R 13/631
439/374

OTHER PUBLICATIONS

Wikipedia, "Space monkey," retrieved from https://en.wikipedia.org/wiki/Space_Monkey_(company) Dec. 20, 2016 (2 pages).

* cited by examiner

150

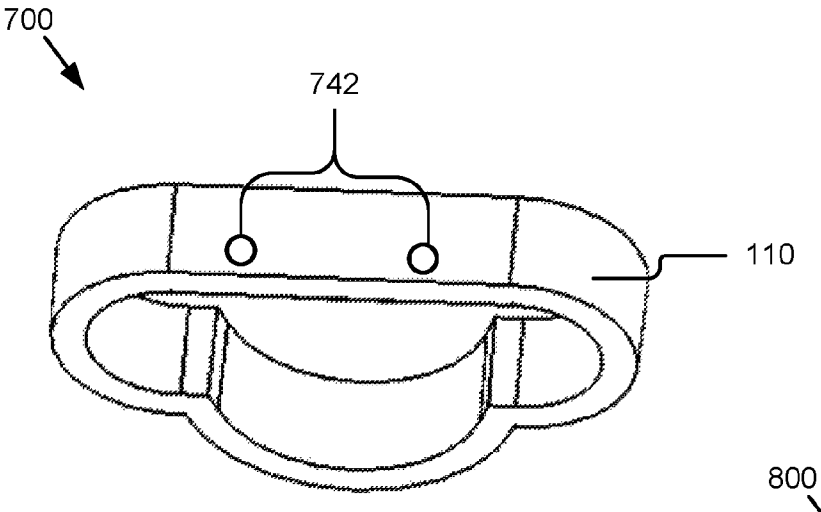
Figure 7
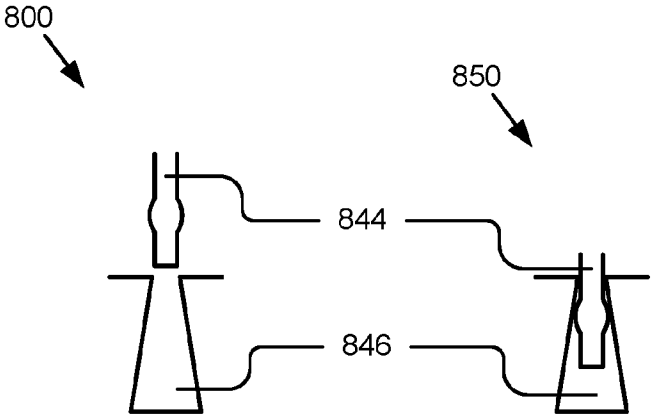
Figure 8A
Figure 8B

PERIPHERAL DEVICE COUPLING

CROSS-REFERENCE TO RELATED APPLICATIONS

This application claims the benefit under 35 U.S.C. § 119(e) of U.S. Provisional Application No. 62/222,980, entitled "An Aesthetic Mechanism to Guide and Fasten Paired Components with Arbitrary Paired Connectors," filed on Sep. 24, 2015, the entire contents of which are incorporated herein by reference.

BACKGROUND

The present invention relates generally to peripheral devices and, in a more specific example, the coupling of peripheral devices.

To connect a peripheral to a computer device, such as when connecting an external hard drive to a DVR or Home Gateway Device, the user must be acutely aware of the orientation of the connector—particularly whether it is right-side up or upside down—and often has to pull out the device, reach around the back, and then plug in the peripheral using data and/or power cables. Because various connectors differ in their orientation and how loose or tight they are, this can be frustrating and may damage or weaken the connectors. Additionally, the clutter created by using cables may be unattractive.

Existing systems for connecting peripheral and computer devices usually involve cabling or using a connector by itself to secure the pairing. There are other fastening mechanisms such as rugged connectors to more tightly secure or waterproof, but they are neither self-guiding nor aesthetic and usually expose threads or clutches. Even among highly proprietary and nonstandard connectors, the issues of guided orientation and aesthetics are left unaddressed.

SUMMARY

According to one innovative aspect of the subject matter described in this disclosure, a self-aligning mechanism may include a coarse guide including a first coarse guide component connected to a first device and a second coarse guide component connected to a second device, the first coarse guide component configured to interact with the second coarse guide component to positionally align a connector pair, the connector pair including a connector and a connector receptacle, the connector connected to the first device and the connector receptacle connected to the second device, the coarse guide configured to prevent the connector from being inserted into the connector receptacle until the connector and the connector receptacle are positionally aligned; and a fine guide including a first fine guide component connected to the first device and a second fine guide component connected to the second device, the first fine guide component configured to interact with the second fine guide component to rotationally align the connector with the connector receptacle, the fine guide configured to prevent the connector from being inserted into the connector receptacle until the connector and the connector receptacle are rotationally aligned.

According to another one innovative aspect of the subject matter described in this disclosure, a peripheral device may include a surface; a positional guide component attached to the surface, the positional guide component configured to positionally align a connector with a connector receptacle, the positional guide configured to prevent the connector from being inserted into the connector receptacle until the connector and the connector receptacle are positionally aligned; and a rotational guide component attached to the surface, the rotational guide component configured to rotationally align the connector with the connector receptacle, the rotational guide component configured to prevent the connector from being inserted into the connector receptacle until the connector and the connector receptacle are rotationally aligned.

According to another one innovative aspect of the subject matter described in this disclosure, stackable self-aligning device system may include a first device including a first device body, a first coarse guide component connected to the first device body, a first fine guide component connected to the first device body, and a first connector component connected to the first device body; and a second device including a second device body, a second coarse guide component connected to the second device body, the second coarse guide component configured to interact with the first coarse guide component to positionally align the first connector component with a second connector component, the second coarse guide component configured to prevent the first connector component from contacting the second connector component until the first connector component and the second connector component are positionally aligned, a second fine guide component connected to the second device body, the second fine guide component configured to interact with the first fine guide component to rotationally align the first connector component with the second connector component, the second fine guide component configured to prevent the first connector component from contacting the second connector component until the first connector component and the second connector component are rotationally aligned, and the second connector component connected to the second device body.

These and other implementations may each optionally include one or more of the following features: that the first coarse guide component includes a protrusion positioned along at least a portion of a surface of the first device; that the second coarse guide component includes a receptacle positioned along at least a portion of a surface of the second device, the receptacle of the second coarse guide component configured to accept the protrusion of the first coarse guide component; that the protrusion of the first coarse guide component and the receptacle of the second coarse guide component are each rotationally symmetrical, the first device being rotatable relative to the second device while the coarse guide maintains the connector pair in positional aligning when the connector pair is positionally aligned using the coarse guide; that the first fine guide component includes a protrusion positioned along at least a portion of a surface of the first device; that the second fine guide component includes a receptacle positioned along at least a portion of a surface of the second device, the receptacle of the second fine guide component configured to accept the protrusion of the first fine guide component; the protrusion of the first fine guide component and the receptacle of the second fine guide component are rotationally asymmetrical and mirror images of each other, the connector being insertable into the connector receptacle when the connector pair is rotationally aligned using the fine guide; that the first device includes a computer peripheral; the first device includes a hard drive and the second device includes an internet connected hub configured to connect the hard drive to the Internet; the first device and the second device each have both a first self-aligning component and a second self-aligning component so that the first device and the second device are stackable with one or more additional devices; that the first device and the second device are the same type of peripheral devices.

In general, another innovative aspect of the subject matter described in this disclosure may be embodied in methods that include operations for the use and manufacture of the system described herein.

It should be understood that the language used in the present disclosure has been principally selected for readability and instructional purposes, and not to limit the scope of the subject matter disclosed herein.

BRIEF DESCRIPTION OF THE DRAWINGS

The disclosure is illustrated by way of example, and not by way of limitation, in the figures of the accompanying drawings in which like reference numerals are used to refer to similar elements.

FIG. 7 is a perspective view of an example implementation of an isolated first fine guide component.

FIGS. 8A and 8B are side cutout views of an example implementation of a clutch.

DETAILED DESCRIPTION

Figure 1A:
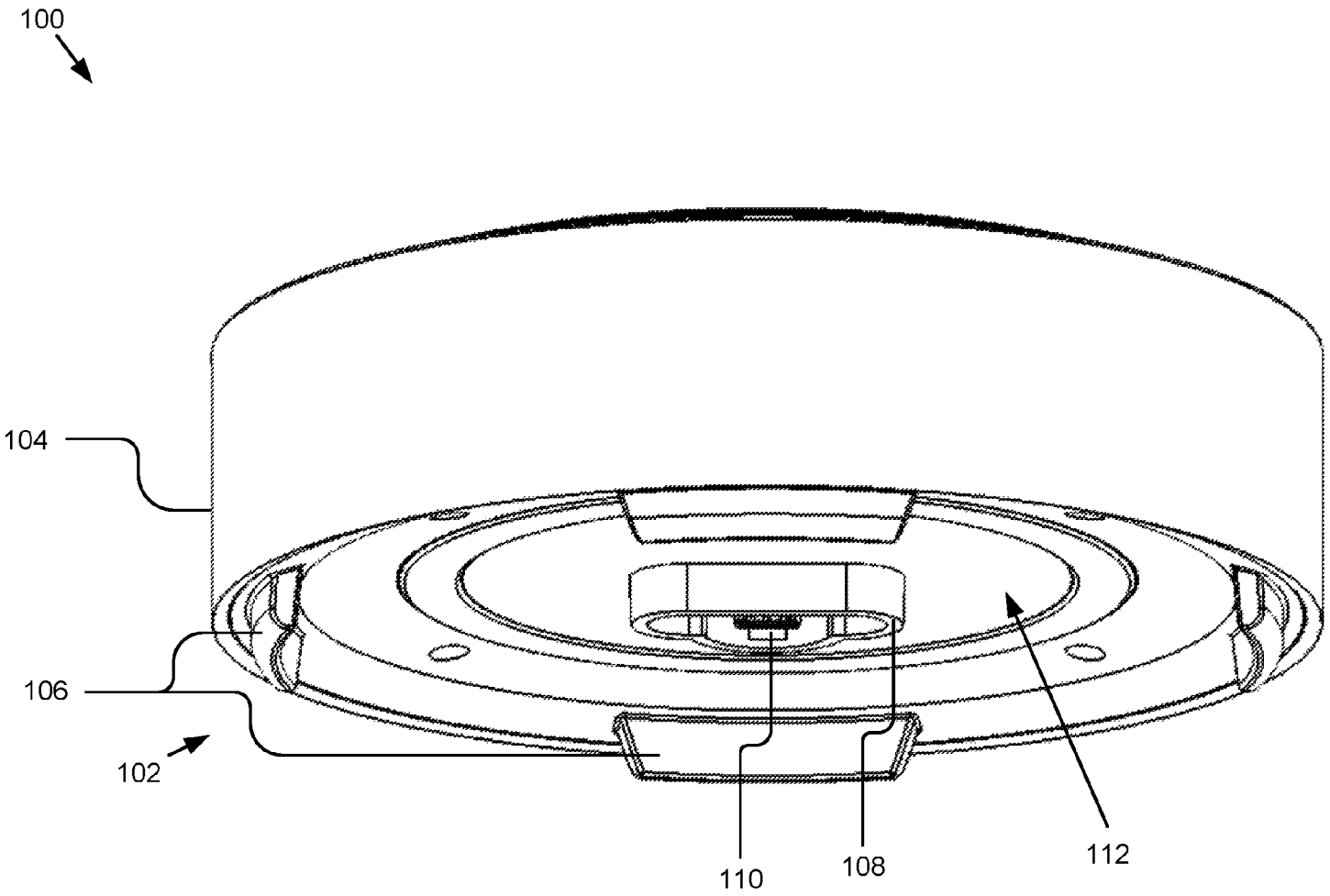
FIG. 1A is a bottom-perspective view of an example implementation of a peripheral device, according to the present disclosure.

For the purposes of this disclosure, reference numbers may be used to refer to components found in any of the figures, regardless whether those reference numbers are shown in the figure being described. Further, where a reference number includes a letter referring to one of multiple similar components (e.g., component 000a, 000b, and 000n), the reference number may be used without the letter to refer to one or all of the similar components.

The present disclosure describes an innovative self-aligning coupling technology that can automatically guide and fasten components being coupled or paired, such as peripheral devices that communicate or connect using paired connectors. In some implementations, the technology includes a self-aligning mechanism that may attach to, be integrated with, or otherwise included in, one or more peripheral devices. The technology advantageously enables users to mate compatible connectors of computing or peripheral devices correctly and securely in a more aesthetic way.

The technology described herein solves many of the shortcomings of existing connectors, such as are described in the background section of this disclosure. For example, for peripheral devices that have been designed to be mated with a computing device or peripheral device hub, the technology described herein may enable the user to mate the connectors of the peripheral device without seeing or knowing the orientation of the connectors beforehand, without additional cables, and without damage to the connectors. Instead, in some implementations, the user can slide the peripheral device across another device (e.g., a peripheral device hub or another peripheral device) until the self-aligning mechanism is guided into a first layer of connection (e.g., using a coarse guide, as described elsewhere herein). The user may then twist the peripheral device until the self-aligning mechanism is guided into a second layer of connection (e.g., using a fine guide, as described elsewhere herein). Once the self-aligning mechanism is guided into the second layer of connection, the user may push the peripheral device or connector to secure the connection at a third layer of connection (e.g., using a connector pair, as described elsewhere herein). Furthermore the self-aligning mechanism may be designed to be aesthetic, for example, the self-aligning mechanism may be configured to operate without exposed screw threads, so that the self-aligning mechanism itself can be both functional and aesthetically pleasing.

In some implementations, the self-aligning mechanism includes a coarse guide, a fine guide, a connector pair, and/or a clutch. In some implementations, the self-aligning mechanism may include a first self-aligning component and a second self-aligning component, which are configured to interact with each other to positionally and rotationally align the connector pair. The coarse guide may include a mated pair of a first coarse guide component and a second coarse guide component (e.g., a well or coarse guide component receptacle). The fine guide may include a mated pair of a first fine guide component and a second fine guide component (e.g., a well a fine guide component receptacle). The connector pair may include a first connector component (e.g., a male connector) and a second connector component (e.g., a female connector or connector receptacle). The clutch may include any type of grasping mechanism for retaining one or more of the coarse guide, fine guide, connector pairs, or other components of two or more devices in connection.

It should be noted that, for the purposes of this disclosure, a self-aligning mechanism may include a first half (e.g., a first self-aligning component) and a second half (e.g., a second self-aligning component) compatible with and configured to attach to the first half. For example, a first half may include one or more male alignment components (e.g., alignment components may include apparatuses, such as coarse guides, fine guides, and connectors) and the second half may include one or more compatible female alignment components, or each half may include a combination of male and female alignment components. Further, it should be noted that although some components of the self-aligning mechanism are described as having certain structures (e.g., male or female structures, protrusions, wells, receptacles, etc.), these structures are provided by way of example and are not to be construed as limiting.

FIG. 1A is a bottom-perspective view 100 of an example implementation of a peripheral device 104, according to the present disclosure. The peripheral device 104 includes a first self-aligning component 102 that may be connected to or integrally formed into a bottom surface 112 of the peripheral device 104. The bottom, top, sides, etc., of the components described herein are for illustration purposes only and are not to be construed as limiting, for example, because the components may be reoriented in different directions. It should be noted that some of the components of the first self-aligning component 102 may take other forms or may be exchanged with those components of the second self-aligning component 202 (e.g., as shown and described in reference to FIG. 2A).

The peripheral device 104 may include any device that may be connected to another device using a connector pair. For example, the peripheral device 104 may include an external hard drive, a battery, a speaker, or any other connectable or modular device or housing containing a modular component or peripheral computing device.

The peripheral device 104 may include a body having one or more of a first or a second self-aligning component 102 and 202. The body may define an interior cavity (e.g., 630, as described in FIG. 6). As shown in the depicted implementation, the peripheral device 104 may include a cylindrical shape, however other shapes and configurations are possible and contemplated herein. In some implementations, a bottom surface 112 of the peripheral device 104 may include a slightly concave (or, in some implementations, convex) shape to further allow the bottom surface 112 to interact with a top surface 212 of another device. Further, in some implementations, the bottom surface 112 of the peripheral device 104 may include one or more vents (e.g., located around a perimeter of the bottom surface 112 or the top surface 212 within or outside of the radius of the coarse guide).

A connector pair may include a first connector component 110 and a second connector component 210. For example, a connector pair may include a mated/mate-able male/female connector pair. The connector pair may include proprietary connectors or standard connectors, such as, but not limited to USB (e.g., USB 2.0, USB 3.0, etc.), HDMI, eSATA, VGA, DVI, Thunderbolt, FireWire, etc. In particular, the self-aligning mechanism described herein is particularly beneficial for connector pairs which require one or more specific orientations to mate.

In some implementations, the first self-aligning component 102 may include a first coarse guide component 106, a first fine guide component 108, and/or a first connector component 110.

Figure 2A:
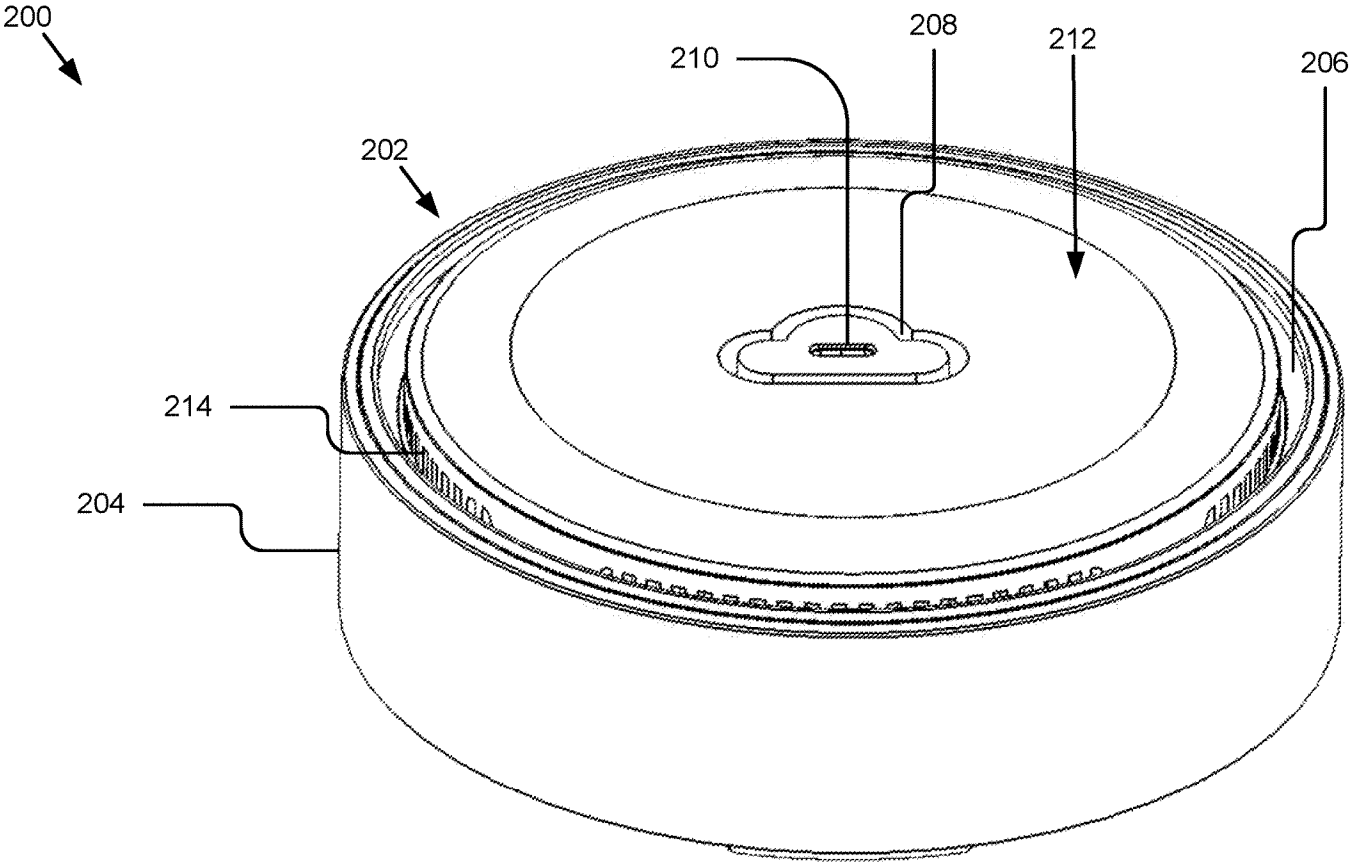
FIG. 2A is a top-perspective view of an example implementation of a peripheral device, according to the present disclosure.

The first coarse guide component 106 may be connected to or integrally formed on a bottom surface 112 of the peripheral device 104 and may be configured to interact with a second coarse guide component 206 (e.g., as shown in FIG. 2A) to positionally align a connector pair (e.g., the first connector component 110 and the second connector component 210). For example, the term positionally align may mean aligning the components over each other in a two-dimensional plane and/or with a correct tilt (e.g., parallel, normal, perpendicular) relative to each other.

The first coarse guide component 106 may be configured to slide into place with (e.g., within) the second coarse guide component 206 to position the first connector component 110 above the second connector component 210. Once the first coarse guide component 106 is in place with the second coarse guide component 206, the peripheral device 104 may be allowed to rotate about an axis with a second device (e.g., a device having a second self-aligning component 202). Further, the coarse guide, may prevent the first connector component 110 from being inserted into or interacting with the second connector component 210 when the coarse guide components are out of positional alignment.

In some implementations, the first coarse guide component 106 may be in the shape of a ring, although other shapes are possible. For example, the first coarse guide component may be rotationally symmetrical (e.g., invariant to a rotational transformation about a particular axis). The first coarse guide component 106 may be positioned along at least a portion of the bottom surface 112 of the peripheral device 104 and may, in some instances, include one or more protrusions. For example, as shown in FIG. 1A, the first coarse guide component 106 may include one or more protrusions positioned along a perimeter the bottom surface 112 of the peripheral device 104. Although a solid ring protrusion may be used for aesthetics, cutouts can be used for ventilation or auxiliary cable or component routing. For example, in some implementations, the space between and defined by the protrusions, the bottom surface 112, and the top surface 212 may be sized and/or positioned to correspond to vents 214, as described elsewhere herein.

The first coarse guide component 106 may be slightly taller than the first fine guide component 108, so that the first fine guide component 108 does not contact the second fine guide component 208 (or, in some instances, a top surface of a second device or second self-aligning component 202) until the first coarse guide component 106 is positionally aligned with the second coarse guide component 206. Additionally, the width of the first coarse guide component 106 and second coarse guide component 206 may be graduated in a subtle thread-like manner to further assist guiding and/or fastening the coarse guide in alignment.

The user can coarsely slide the bottom surface 112 of the peripheral across the top surface 212 of a second device (e.g., any second device having a second self-aligning component 202) until the coarse guide falls into place, regardless of rotational orientation. To prevent scratching, the bottom of each guide can be thinly lined with a scratch resistant material, such as a rubber or plastic band or surface. Alternatively, the scratch resistant material can be wedged into a thin well lining the bottom of a guide (e.g., a coarse guide or a fine guide). As shown in FIG. 1A, the first coarse guide component 106 may be located on the outside/perimeter edge of the bottom surface 112 of the peripheral device 104 for stability when the peripheral device 104 is standing alone on a surface (e.g., a table), but the first coarse guide component 106 could alternatively be placed to the inside of the first fine guide component 108.

The first fine guide component 108 may be connected to or integrally formed on a bottom surface 112 of the peripheral device 104 and may be configured to interact with a second fine guide component 208 (e.g., as shown in FIG. 2A) to rotationally align a connector pair (e.g., the first connector component 110 and the second connector component 210). The first fine guide component 108 may be configured to prevent the first connector component 110 from touching, connecting to, and/or inserting into the second connector component 210 until the first and second connector components 110 and 210 are rotationally aligned. For example, once the first fine guide component 108 is rotationally aligned with the second fine guide component 208, the first and second connector components 110 and 210 may be pushed toward one another, so that the first connector component 110 connects with (e.g., is inserted into) the second connector component 210.

In some implementations, the first fine guide component 106 may be an arbitrary shape (e.g., a cloud shape, as shown, or a logo). For example, the first fine guide component 106 may be rotationally asymmetrical. For the purposes of the fine guide components described herein, rotationally asymmetrical means that the first fine guide component 106 must be in one or more specific rotational positions about an axis (e.g., the axis that is normal to the bottom surface 112 and/or top surface 212) in order to interact with the second fine guide component 206.

The first fine guide component 108 may be positioned along at least a portion of the bottom surface 112 of the peripheral device 104 and may, in some instances, include one or more protrusions. For example, as shown in FIG. 1A, the first fine guide component 108 may include one or more protrusions positioned on the bottom surface 112 of the peripheral device 104 within the radius of the first coarse guide component 106, although other configurations are possible. Although a solid ring protrusion may be used for aesthetics, cutouts can be used for ventilation or auxiliary cable or component routing.

In some implementations, a user may place a peripheral device 104 on top of a second device (e.g., any device having a second self-aligning component 202) and guide it into place by sliding it across the top surface 212 of the second device until the first coarse guide component 106 falls into place with the second coarse guide component 206. The user may then rotate the peripheral device 104 relative to the second device until the first fine guide component 108 aligns and falls into place with the second fine guide component 208. The user may then press down to simultaneously engage a clutch (e.g., as described in FIGS. 7-8B) and connect the connector pair. This process can be easily done even in low lighting and when picking up the second device would be inconvenient.

Additionally, in multi-peripheral applications where aesthetics are an important consideration, each peripheral device 104 can be built with female half of the self-aligning mechanism (e.g., the second self-aligning component 202) on a top surface 212 and the male half of the self-aligning mechanism (e.g., the first self-aligning component 102) on a bottom surface 112 so that multiple peripheral devices 104 can be stacked on top of one another.

Figure 1B:
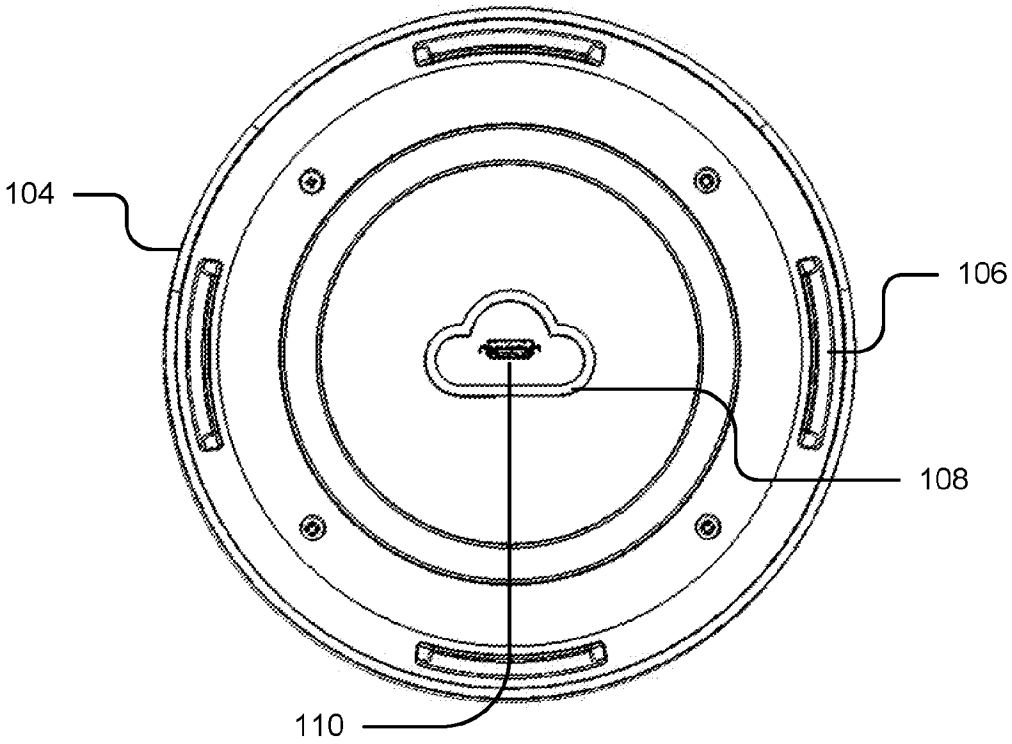
FIG. 1B is a bottom-up view of an example implementation of a peripheral device, according to the present disclosure.

FIG. 1B is a bottom-up view 150 of an example implementation of a peripheral device 104, according to the present disclosure. As shown in the bottom-up view 150, the peripheral device 104 may include a first coarse guide component 106, a first fine guide component 108, and a first connector component 110. Although the shape of the peripheral device 104 is depicted as being circular, it should be noted that it may take other shapes, sizes, or configurations. The peripheral device 104 and/or the components of the self-aligning mechanism may be constructed of plastic, metal, rubber, or any other suitable material.

In some implementations, the diameter of the peripheral device 104 may be approximately 5.5 inches (e.g., 4.5 to 6.5 inches) to accommodate internal components, such as a hard drive, a speaker, a circuit board, etc. In some implementations, the radius of the coarse guide (e.g., one or more of the first and second coarse guide components 106 and 206) may be approximately 3 and ⅜ inches (e.g., 2.5 inches to 4 inches) to provide stability to the peripheral device 104. In some implementations the width of the coarse guide components may be approximately ⅛ inch (e.g., 1/16 to ½ inches). In some implementations the width of the fine guide components may be approximately ⅛ inch (e.g., 1/16 to ½ inches). In some implementations, although the dimensions may change, the proportions of the components may remain substantially the same. Further, it should be noted that similar dimensions as those described above may be applied to one or more of the devices 204, 304, or 404.

FIG. 2A is a top-perspective view 200 of an example implementation of a peripheral device 204, according to the present disclosure. The peripheral device 204 depicted in FIG. 2A may represent the same peripheral device 204 depicted in FIG. 1A or an additional device, which the peripheral device 104 can connect to (e.g., which has a first self-aligning component 102), such as the peripheral device hub 404, depicted in FIG. 4.

As illustrated, the peripheral device 204 includes a second self-aligning component 202. In some implementations, the second self-aligning component 202 may form a mated/mate-able pair with the first self-aligning component 102. As shown in the illustrated implementation, the second self-aligning component 202 may include a second coarse guide component 206, a second fine guide component 208, and/or a second connector component 210.

The second coarse guide component 206 may be connected to or integrally formed on a top surface 212 of the peripheral device 204 and may be configured to interact with a first coarse guide component 106 (e.g., as shown in FIG. 1A) to positionally align a connector pair (e.g., the first connector component 110 and the second connector component 210).

The second coarse guide component 206 may be a corresponding shape to the first coarse guide component 106, for example, the second coarse guide component may be in the shape of a ring or other rotationally symmetrical shape. In some implementations, the second coarse guide component 206 may include a protrusion (e.g., to be positioned alongside the first coarse guide component 106) or a receptacle, such as a well, recessed ring, or other recessed cavity connected to, integrally formed within, or defined by the second self-aligning component 202 or by the top surface 212 of the peripheral device 204. In some implementations, the second coarse guide component 206 may be positioned along at least a portion of the top surface 212, such as along or near a perimeter edge of the top surface 212.

In some implementations, the top surface 212 may include one or more vents. For example, one or more vents 214 may be included with or within the second coarse guide component 206.

The second fine guide component 208 may be connected to or integrally formed on a top surface 212 of the peripheral device 204 and may be configured to interact with a first fine guide component 108 (e.g., as shown in FIG. 1A) to rotationally align a connector pair (e.g., the first connector component 110 and the second connector component 210).

The second fine guide component 208 may be a corresponding shape to the first fine guide component 108, for example, the second fine guide component may be a mirror image of the first fine guide component 108, so that when the connector pair is rotationally aligned using the fine guide, the fine guide components may slide together (e.g., no longer preventing the first and second connector components 110 and 120 from touching or connecting), so the first connector component 110 may connect to or be inserted into the second connector component 210.

In some implementations, the second fine guide component 208 may include a receptacle, such as a well or recessed cavity connected to, integrally formed within, or defined by the second self-aligning component 202 and/or the top surface 212 of the peripheral device 204. In some implementations, the second fine guide component 208 may be positioned on at least a portion of the top surface 212, for example, within the radius of the second coarse guide component 206.

The second connector component 210 may be configured to match the first connector component 110 and may be located at the rotational axis of the second self-aligning component 202, although other configurations are possible and contemplated herein.

Figure 2B:
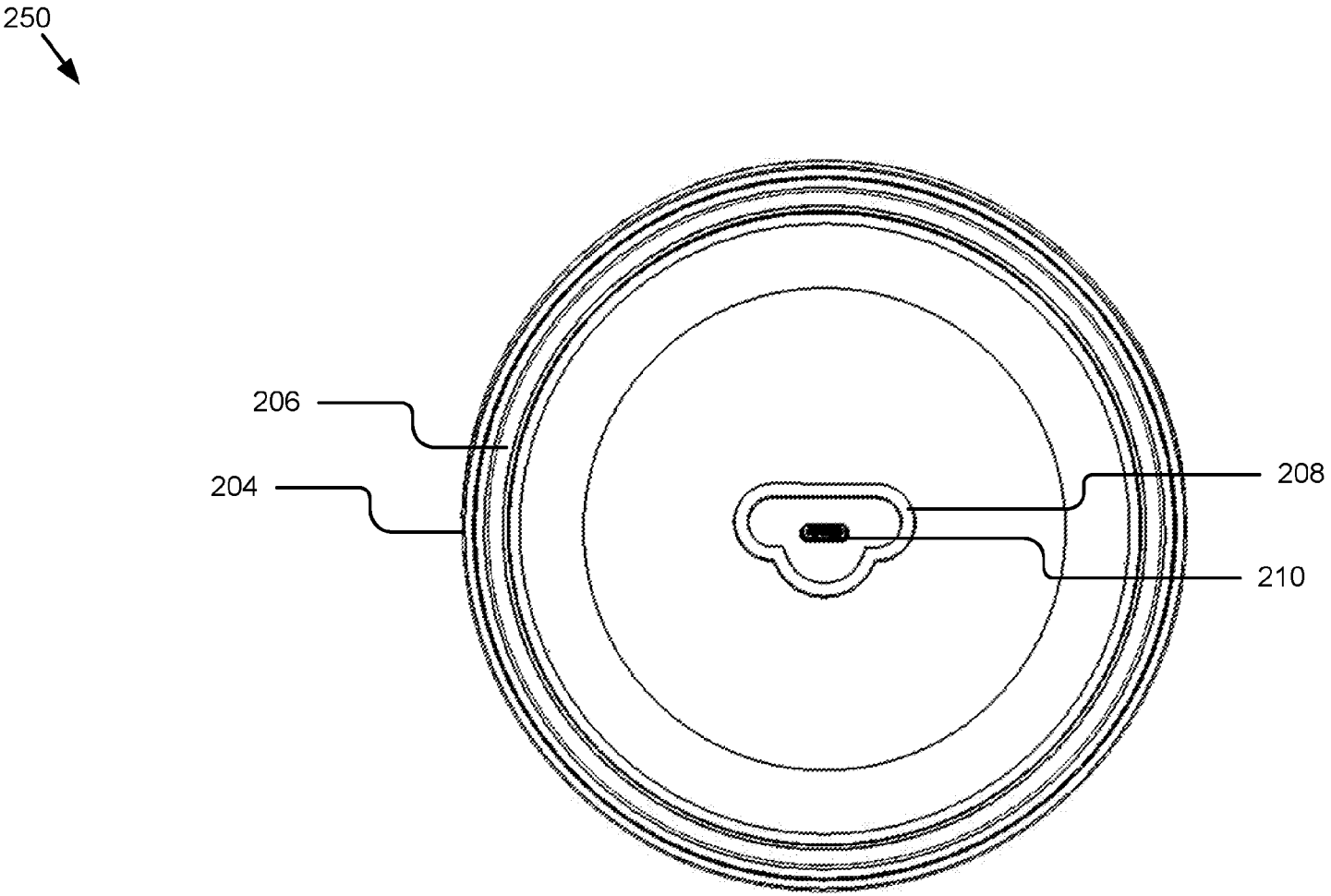
FIG. 2B is a top-down view of an example implementation of a peripheral device, according to the present disclosure.

FIG. 2B is a top-down view 250 of an example implementation of a peripheral device 204, according to the present disclosure. As shown in the top-down view 250, the peripheral device 204 may include a second coarse guide component 206, a second fine guide component 208, and a second connector component 210.

Figure 3:
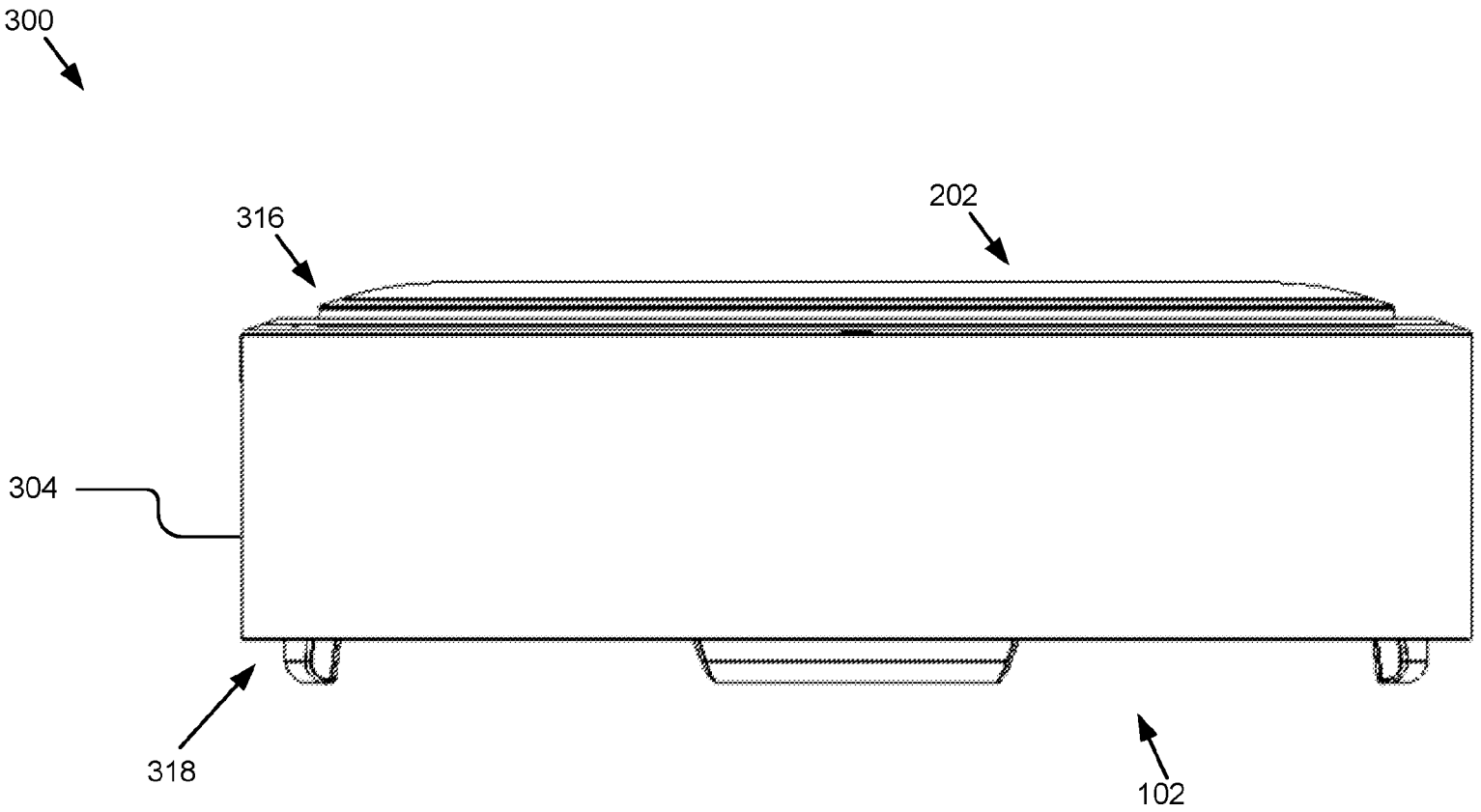
FIG. 3 is a side view of an example implementation of a peripheral device, according to the present disclosure.

FIG. 3 is a side view 300 of an example implementation of a peripheral device 304, according to the present disclosure. The peripheral device 304 may represent one or more of the peripheral devices 104 and/or 204. In the depicted implementation, the peripheral device 304 includes both a first self-aligning component 102 and a second self-aligning component 202, so that the peripheral device 304 may be stackable providing a connection between two or more peripheral devices 304 or a combination of types of devices (e.g., a peripheral device 304 and a peripheral device hub 404).

In the implementation depicted in FIG. 3, the peripheral device 304 may include a convex beveled edge 316 (e.g., at or near the second self-aligning component 202). The peripheral device 304 may also include a concave beveled edge 318 (not visible in FIG. 3) (e.g., at or near the first self-aligning component 102). The convex and concave beveled edges 316 and 318 may form a further aligning mechanism (e.g., a fourth level of alignment) allowing a first peripheral device 304 to easily slide over a second peripheral device (e.g., 204, 304, 404, etc.).

Figure 4:
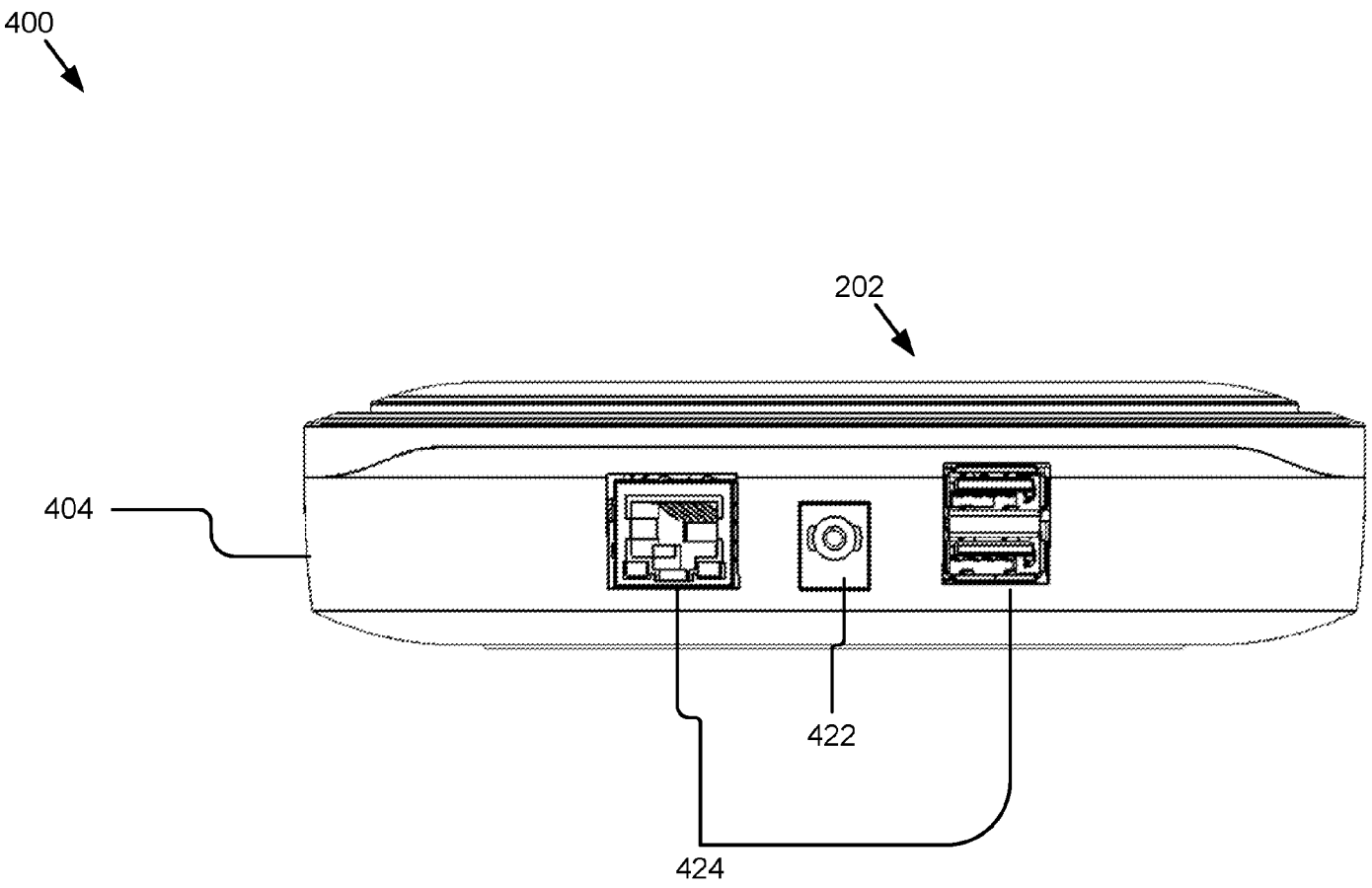
FIG. 4 is a side view of an example implementation of a peripheral device hub, according to the present disclosure.

FIG. 4 is a side view 400 of an example implementation of a peripheral device hub 404, according to the present disclosure. In some implementations, as illustrated in FIG. 4, the peripheral device hub 404 may include only one of the second self-aligning component 202 and the first self-aligning component 102.

In some implementations, the peripheral device hub 404 includes a computing device or an internet connected hub configured to connect a peripheral device (e.g., 104, 204, or 304) to a computing device or the Internet. The peripheral device hub 404 may include an electrical plug 422, processors, input/output devices, data storage devices (e.g., a hard disk drive or solid state drive), non-transitory computer readable memories storing executable instructions, such as operating systems or software for enabling communication between the peripheral device hub 404 and one or more peripheral devices (e.g., 104, 204, 304), the internet, and/or a computing device.

The input/output devices may include or communicate using one or more connector ports 424 or wireless communication technologies (e.g., Bluetooth, Wi-Fi, etc.). The connector ports 424 may include one or more of an Ethernet port, one or more USB ports, a Secure Digital card reader, one or more audio ports, an HDMI port, a Firewire port, a Thunderbolt port, an eSATA port, etc.

It should be noted that a peripheral device (e.g., 304) may also, or alternatively, include some or all of the components or the functionality of the peripheral device hub 404.

Figure 5:
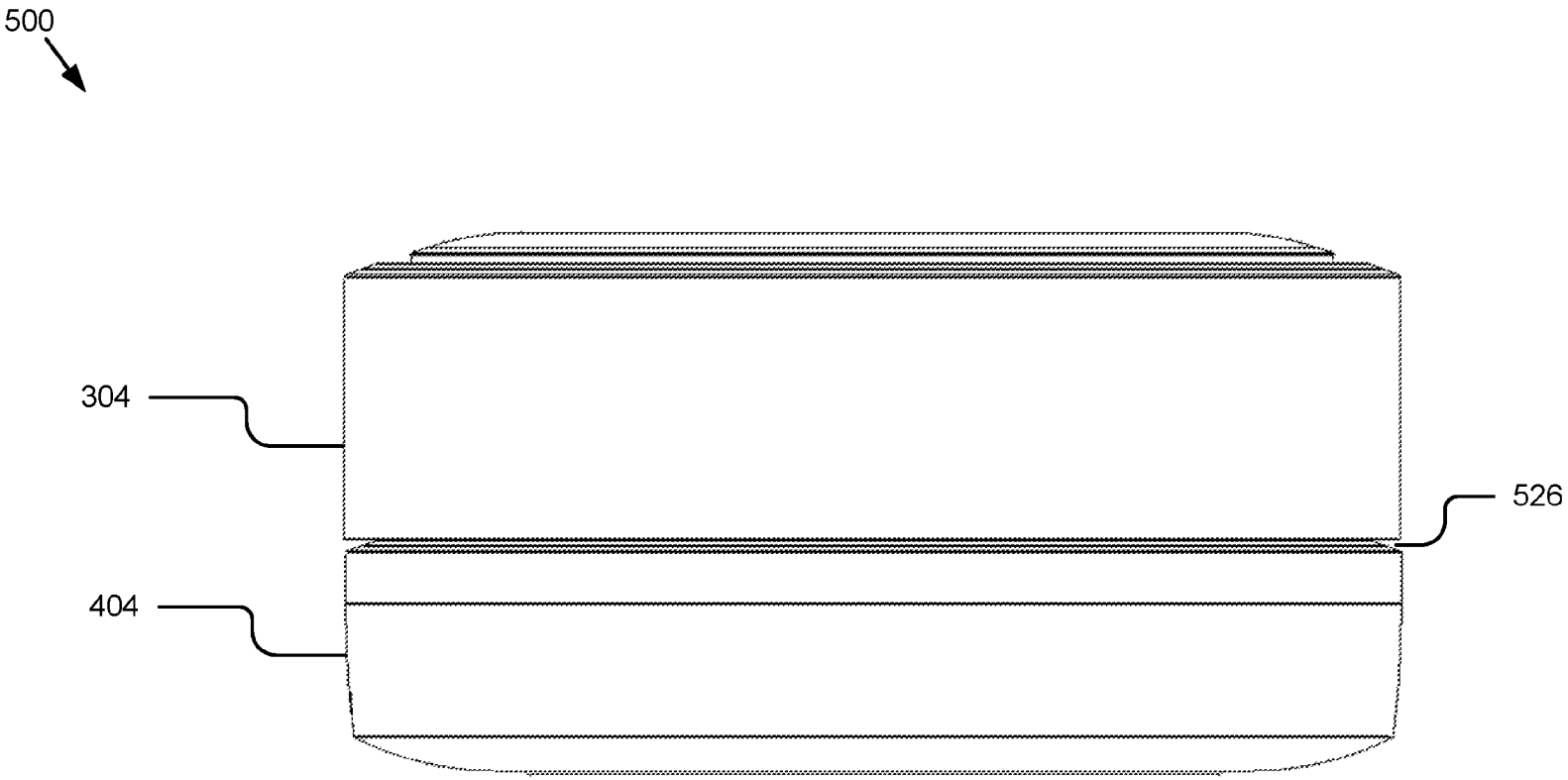
FIG. 5 is a side view of an example implementation of a peripheral device stacked on top of a peripheral device hub, according to the present disclosure.

FIG. 5 is a side view 500 of an example implementation of two or more coupled peripheral devices (e.g., a peripheral device 304 stacked on top of a peripheral device hub 404), according to the present disclosure. The peripheral device 304 may connect to and communicate with the peripheral device 404 via the connector pair, as described elsewhere herein. In some implementations, any number of additional peripheral devices 304 (e.g., 1, 2, 3, 4, 5+, etc.) may be stacked on top of the depicted peripheral device 304, and coupled via compatible self-aligning coupling mechanisms as described herein, to daisy chain the connections between the plurality of stacked peripheral devices 304 and, in some instances, the peripheral device hub 404.

In some implementations, when a peripheral device 304 is stacked on top of a peripheral device hub 404 or another peripheral device 304, the self-aligning mechanism creates a separation 526 between the devices to allow ventilation for the internal components of the devices (e.g., via vents, as described elsewhere herein).

Figure 6:
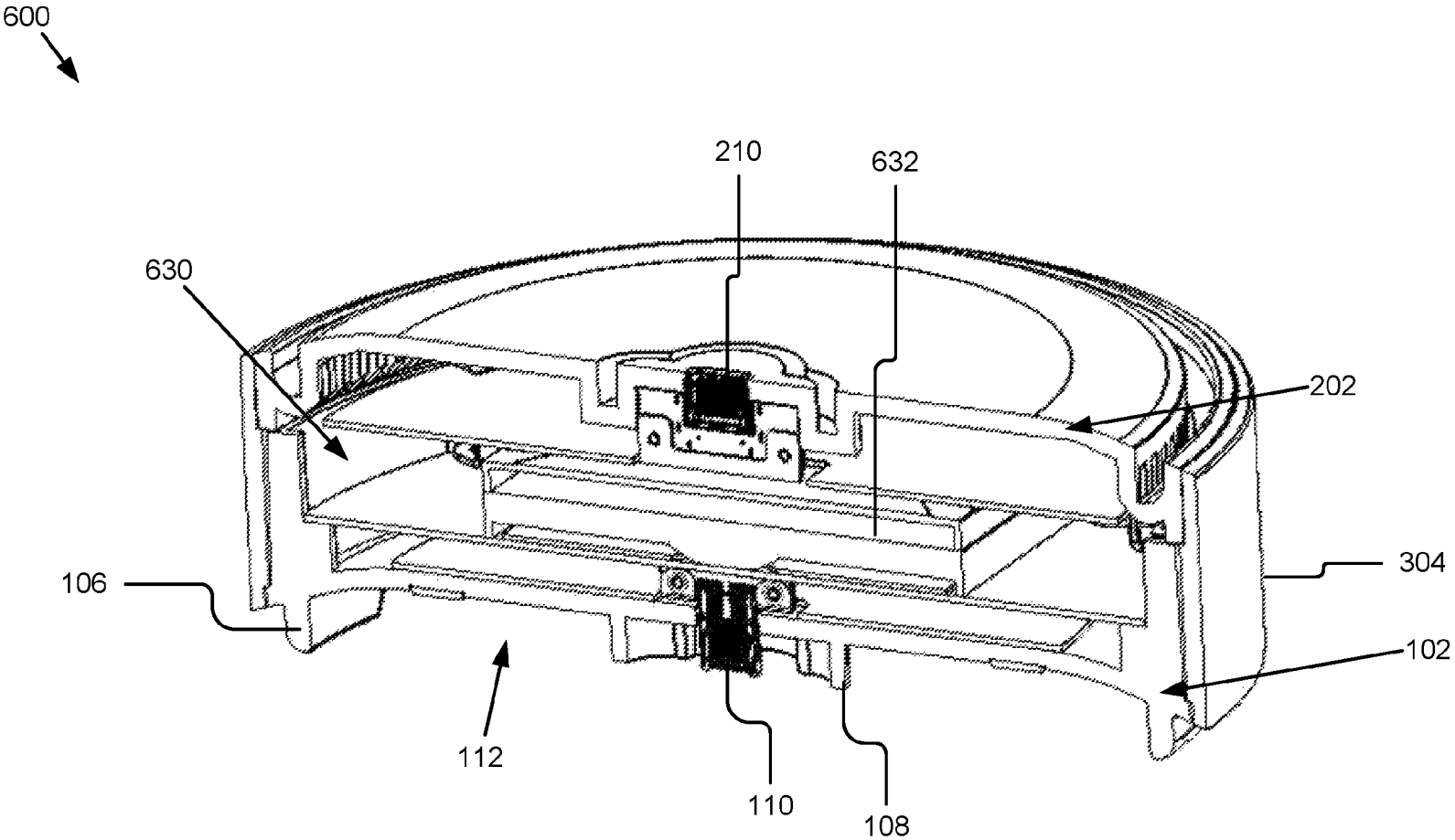
FIG. 6 is a cut-away view of an example implementation of a peripheral device, according to the present disclosure.

FIG. 6 is a cut-away view 600 of an example implementation of a peripheral device 304, according to the present disclosure. The example peripheral device 304 includes a first self-aligning component 102 and a second self-aligning component 202. In some implementations, as depicted, the first coarse guide component 106, the first fine guide component 108, and the first connector component 110 each extend a different distance from the bottom surface 112. For example, the first fine guide component 108 may be longer than the first connector component 110, and the first coarse guide component 106 may be longer than the first fine guide component 108. Accordingly, the first fine guide component 108 is protected and disconnected until the first coarse guide component 106 is aligned. Similarly, the first connector component 110 is protected and disconnected until the first fine guide component 108 is aligned.

As illustrated in the cut-away view 600, the peripheral device 304 may include an interior cavity 630 to house internal components, which internal components may connect to one or both of the first connector component 110 and the second connector component 210 for communication with other devices. As illustrated, the internal components may include a hard drive 632 (e.g., a hard disk drive or solid state drive, etc.), which provides expandable data storage another device, such as a peripheral device hub 404.

FIG. 7 is a perspective view 700 of an example implementation of an isolated first fine guide component 108. As illustrated, the first fine guide component 110 may include one or more example clutches 742, although the clutch(es) 742 may be additionally or alternatively be implemented on one or more of the components 106, 206, 208, 110, and 210 or otherwise on the self-aligning mechanism.

The clutch 742 can be implemented with protrusions, ball bearings, and/or flexible snaps, among other apparatuses. In some implementations, a well (e.g., formed by the second coarse guide component 206, second fine guide component 206, or second connector component 210) may accommodate the clutch 742 with matching protrusions, side wells, ball bearings, and or clutch holds. The clutch 742 of the self-aligning mechanism can be omitted if a clutch mechanism of the connector pair is sufficiently strong for the desired application.

FIGS. 8A and 8B are side cutout views 800 and 850, respectively, of an example implementation of a clutch 742. As illustrated, the clutch 742 may include a protrusion 844 (or a ball bearing, flexible snap, etc.) and a well 846 (or other shape to receive and retain the protrusion, as described above). The protrusion 844 may be a portion of the first coarse guide component 106 and/or the first fine guide component 108, for example. Similarly, the well 846 may be a portion of the second coarse guide component 206 and/or the second fine guide component 208, for example.

The self-aligning mechanism described herein may also or alternatively be used for screw-less assembly of self-assembled consumer products and toys —particularly where orientation is important, but difficult to tell at-a-glance, or where forceful improper orientation may damage such a product. Although the figures show a very thin mechanism, the width and depth can be adjusted to be used in various household products to assist those with coarse motor skills—such as children and elderly.

Although the invention has been explained in relation to its preferred implementations, it is to be understood that many other possible modifications and variations can be made without departing from the spirit and scope of the invention. Further, in the foregoing description, for purposes of explanation, numerous specific details are set forth in order to provide a thorough understanding of the technology. It will be apparent, however, that the technology described herein can be practiced without these specific details.

Reference in the specification to "one implementation", "an implementation", "some implementations", or "other implementations" means that a particular feature, structure, or characteristic described in connection with the implementation is included in at least one implementation of the disclosure. The appearances of the term "implementation" or "implementations" in various places in the specification are not necessarily all referring to the same implementation.

In addition, it should be understood and appreciated that variations, combinations, and equivalents of the specific implementations, implementations, and examples may exist, are contemplated, and are encompassed hereby. The invention should therefore not be limited by the above described implementations, implementations, and examples, but by all implementations, implementations, and examples, and other equivalents within the scope and spirit of the invention as claimed.

What is claimed is:

1. A self-aligning mechanism comprising:

a coarse guide including a first coarse guide component connected to a first device and a second coarse guide component connected to a second device, the first coarse guide component configured to interact with the second coarse guide component to guide a connector pair into positional alignment, the connector pair including a connector and a connector receptacle, the connector connected to the first device and the connector receptacle connected to the second device, the coarse guide configured to prevent the connector from being inserted into the connector receptacle until the connector and the connector receptacle are positionally aligned; and a fine guide including a first fine guide component connected to the first device and a second fine guide component connected to the second device, the first fine guide component configured to interact with the second fine guide component to guide the connector and the connector receptacle into rotational alignment, the fine guide configured to prevent the connector from being inserted into the connector receptacle until the connector and the connector receptacle are rotationally aligned.

2. The self-aligning mechanism of claim 1, wherein the first coarse guide component includes a protrusion positioned along at least a portion of a surface of the first device, and the second coarse guide component includes a receptacle positioned along at least a portion of a surface of the second device, the receptacle of the second coarse guide component configured to accept the protrusion of the first coarse guide component.

3. The self-aligning mechanism of claim 2, wherein the protrusion of the first coarse guide component and the receptacle of the second coarse guide component are each rotationally symmetrical, the first device being rotatable relative to the second device while the coarse guide maintains the connector pair in positional aligning when the connector pair is positionally aligned using the coarse guide.

4. The self-aligning mechanism of claim 1, wherein the first fine guide component includes a protrusion positioned along at least a portion of a surface of the first device, and the second fine guide component includes a receptacle positioned along at least a portion of a surface of the second device, the receptacle of the second fine guide component configured to accept the protrusion of the first fine guide component.

5. The self-aligning mechanism of claim 4, wherein the protrusion of the first fine guide component and the receptacle of the second fine guide component are rotationally asymmetrical and mirror images of each other, the connector being insertable into the connector receptacle when the connector pair is rotationally aligned using the fine guide.

6. The self-aligning mechanism of claim 1, wherein the first device includes a computer peripheral.

7. The self-aligning mechanism of claim 1, wherein the first device includes a hard drive and the second device includes an internet connected hub configured to connect the hard drive to the Internet.

8. The self-aligning mechanism of claim 1, wherein the first device and the second device each have both a first self-aligning component and a second self-aligning component so that the first device and the second device are stackable with one or more additional devices.

9. The self-aligning mechanism of claim 1, wherein the first device and the second device are the same type of peripheral devices.

10. A peripheral device comprising a surface;

a positional guide component attached to the surface, the positional guide component configured to guide a connector into positional alignment with a connector receptacle, the positional guide configured to prevent the connector from being inserted into the connector receptacle until the connector and the connector receptacle are positionally aligned; and a rotational guide component attached to the surface, the rotational guide component configured to guide the connector into rotational alignment with the connector receptacle, the rotational guide component configured to prevent the connector from being inserted into the connector receptacle until the connector and the connector receptacle are rotationally aligned.

11. A stackable self-aligning device system comprising:

a first device including:

a first device body;

a first coarse guide component connected to the first device body;

a first fine guide component connected to the first device body; and a first connector component connected to the first device body; and a second device including:

a second device body;

a second coarse guide component connected to the second device body, the second coarse guide component configured to interact with the first coarse guide component to guide the first connector componentinto positional alignment with a second connector component, the second coarse guide component configured to prevent the first connector component from contacting the second connector component until the first connector component and the second connector component are positionally aligned;

a second fine guide component connected to the second device body, the second fine guide component configured to interact with the first fine guide component to guide the first connector component into rotational alignment with the second connector component, the second fine guide component configured to prevent the first connector component from contacting the second connector component until the first connector component and the second connector component are rotationally aligned; and the second connector component connected to the second device body.

* * * * *